United States Patent [19]

Phillips

[11] Patent Number: 4,530,648

[45] Date of Patent: Jul. 23, 1985

[54] WALL CLIMBING FORM HOIST

[75] Inventor: Jim D. Phillips, Des Moines, Iowa

[73] Assignee: Economy Forms Corporation, Des Moines, Iowa

[21] Appl. No.: 601,717

[22] Filed: Apr. 18, 1984

[51] Int. Cl.[3] ..... E04G 11/28

[52] U.S. Cl. ..... 425/65; 249/20; 264/33

[58] Field of Search ..... 249/19, 20, 22; 425/63, 425/65; 264/33, 34; 52/122.1

[56] References Cited

U.S. PATENT DOCUMENTS

| | | | |
|---|---|---|---|
| 2,620,543 | 12/1952 | Scharsach | 425/65 |
| 3,628,223 | 12/1971 | Babee | 249/20 |
| 3,778,491 | 12/1973 | Andreev et al. | 264/33 |
| 4,016,228 | 4/1977 | Schmidt | 249/20 |
| 4,060,358 | 11/1977 | Fougea | 249/20 |
| 4,128,610 | 12/1978 | Ahlgren | 249/20 |

FOREIGN PATENT DOCUMENTS

| | | | |
|---|---|---|---|
| 0018014 | 10/1980 | European Pat. Off. | 249/20 |
| 2814141 | 10/1978 | Fed. Rep. of Germany | 249/20 |
| 1004045 | 3/1952 | France | 425/63 |
| 2307940 | 11/1976 | France | 249/20 |
| 190664 | 7/1957 | German Democratic Rep. | 249/20 |

*Primary Examiner*—Jay H. Woo
*Assistant Examiner*—James C. Housel
*Attorney, Agent, or Firm*—Rudolph L. Lowell

[57] ABSTRACT

A climbing form for progressively raising a form assembly in the construction of a concrete wall comprises has a support frame that adjustably carries a mast form unit, a main mast assembled with the frame for relative up and down movement, and a jib mast, equipped with a lifting means, extended upwardly from the main mast. A carriage within the main mast is releasably locked to the frame when the main mast is moved relative to the frame, and is releasable for up and down movement within the upper section of the main mast to raise and lower a jib form unit. A reversible nut and shaft drive means has the shaft rotatably supported in the mast upper section with the nut mounted on the carriage. With the lower section of the mast secured to the wall, and the frame and carriage in locked engagement, the drive means operates to raise the frame and carriage relative to the main mast to a new pouring position for the mast form unit. The carriage is then released from the frame and the drive means is again operated to raise and lower the carriage within the upper mast section to actuate a lift means to move the jib form unit into position with the mast form unit for a new pour. When the new pour has set the carriage is moved again by the drive means into a locking position with the frame after which the lower mast section is released from the wall and raised by the drive means to a new secured position on the wall. The cycle of setting the form assembly for a new pour is then repeated.

7 Claims, 15 Drawing Figures

FIG. 7
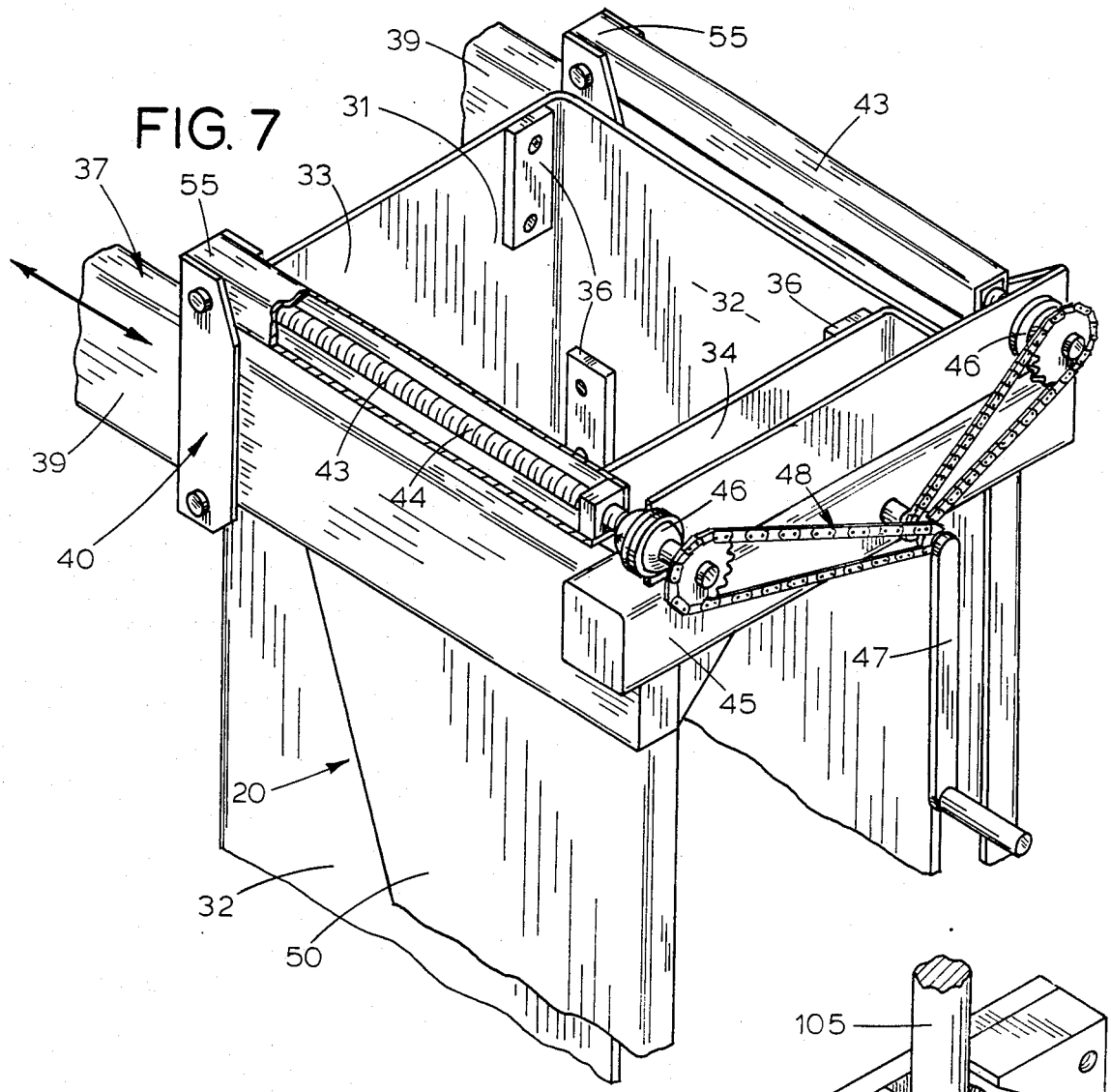
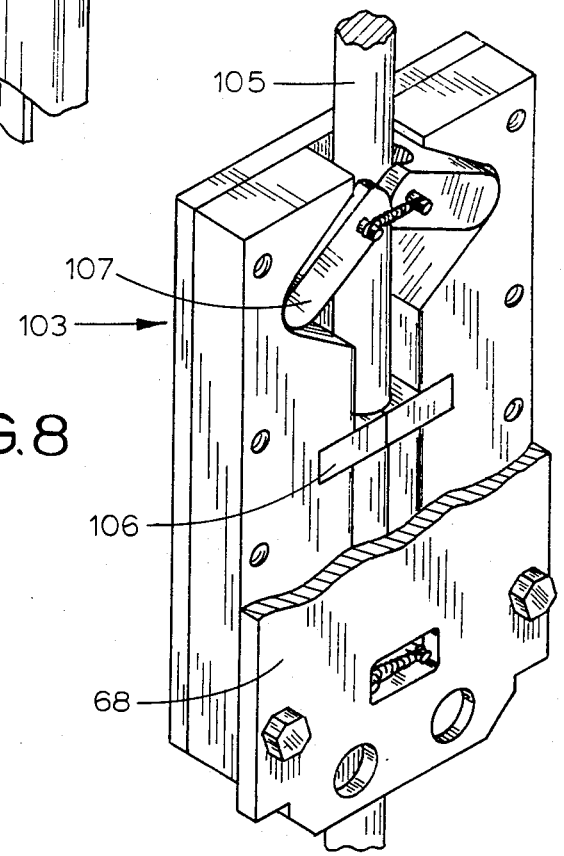
FIG. 8

WALL CLIMBING FORM HOIST

BACKGROUND OF THE INVENTION

This invention relates to hoists used in building concrete walls and in particular to a wall climbing form hoist for handling form units in the construction of concrete wall structures for multi-story buildings.

In the construction of a multi-story building, such as an office building, apartment building and the like, these buildings may have thirty or more floors. Where concrete is used in the construction of the outside walls, it is necessary to provide cranes in the setting up and then stripping of the forms from a set wall panel for reuse in continuing the completion of the wall. Unless a crane is available as required in the setting up and stripping of the forms the wall not only becomes costly, but additional cost increases are incurred by lost time on other operations, that must be performed on a meshing or synchronized time schedule with the wall forming operation. It is apparent also that appreciable down time of the crane may take place, when it could be more efficiently utilized on other jobs at the building site. Where open crane time for timely handling of the form units is not available, construction usually proceeds behind schedule with resultant monetary losses. In some instances, the size of the building being constructed relative to the building site may preclude the use of a crane.

A system for constructing concrete walls about two stories high are shown in U.S. Pat. No. 2,516,318; and for multi-story buildings, in U.S. Pat. Nos. 4,043,087; and 2,118,374. Self-lifting form systems now in use are generally cumbersome and, although inconvenient to manipulate during both a wall climbing operation and a form handling operation, have been found to be generally satisfactory. U.S. Pat. No. 3,628,223 discloses a climbing form hoist that includes a telescopic mast comprised of a pair of vertical lower mast sections for telescopically receiving associated upper mast sections which are extended and retracted by a common reversible electric motor. The upper mast sections carry an outer form unit. With the mast retracted and attached at its lower end to a completed lower wall section, the inner and outer form units are braced or tied together in any well-known manner after which a new lift or wall section is poured. When the new pour has set, the outer form unit, after being stripped from the wall structure, is elevated by the extension of the upper mast sections to a new pour position wherein its lower end is attachable to the previously poured wall section. The lower mast sections are then released from the wall, the upper mast section is retracted and the lower mast section again connected to the wall. The inner form unit is then repositioned for another lift to be poured.

SUMMARY OF THE INVENTION

The wall climbing form hoist of the present invention provides for an appreciable reduction both in the amount of labor and crane time required in the construction of a multistory outside concrete wall. The hoist is efficient in operation to handle both the inside and the outside form units for the pouring and setting of successive lifts or horizontal wall sections and is readily adapted for handling form gangs. The hoist is electrically operated and remotely controlled and includes a platform or scaffold upon which workmen can be safely carried. A base or supporting frame carries the platform and the outer form unit. A main mast having a jib mast extended upwardly therefrom is movably carried on the base frame for relative up and down movement by a screw and nut drive system which is reversely actuated by an electric motor.

With the first three stories of the concrete wall structure previously constructed in any suitable manner, the hoist is lifted in position by a crane to provide for the securement of the lower end section of the main mast to the wall and the setting of the outer form unit and an inner form unit for a new pour. When the new pour has set, the main mast is disconnected from the wall and moved upwardly a story height for reconnection of the lower portion thereof to the wall. The outer or mast form unit is then broken loose from the set pour and the support frame moved upwardly relative to the main mast to locate the mast form unit in a next pour position wherein the lower end thereof is attached to a base sill secured to the set pour. With the support frame and main mast in fixed relative positions a lift means on the jib mast is operated to position the inner or jib form unit for assembly with the mast form unit on the set pour. This handling of the jib form unit is accomplished by the use of the nut and screw assembly in operative association with an elevator member in the main mast and a lift means on the jib mast. A new pour is then made and the cycle of operations repeated until a desired height of the wall structure is attained. At such time a crane is required to lower the climbing form hoist to the ground.

DESCRIPTION OF THE DRAWINGS

FIG. 7 is an enlarged detail perspective view of the supporting frame showing part of the structure for horizontally adjusting and/or for stripping the mast form unit from a set pour of the wall structure;

FIG. 8 is a detail perspective view with parts broken away showing an emergency brake mechanism for locking the support frame and main mast against relative movement;

DESCRIPTION OF THE INVENTION

Figure 1:
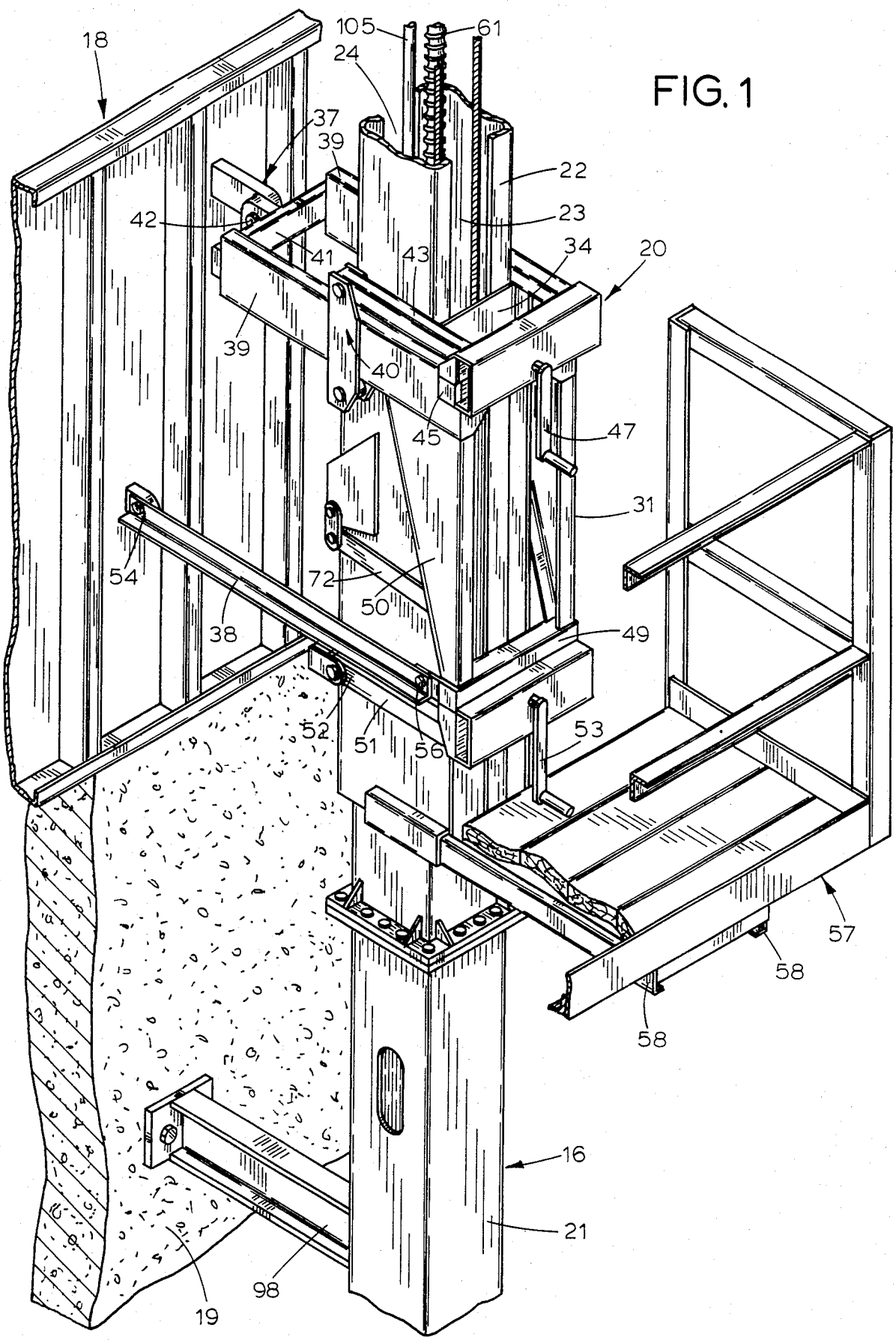
FIG. 1 is a detail perspective view of the wall climbing form hoist with sections removed to more clearly show the construction and assembly relation of the supporting frame, the main mast and the mast form unit.
Figure 2:
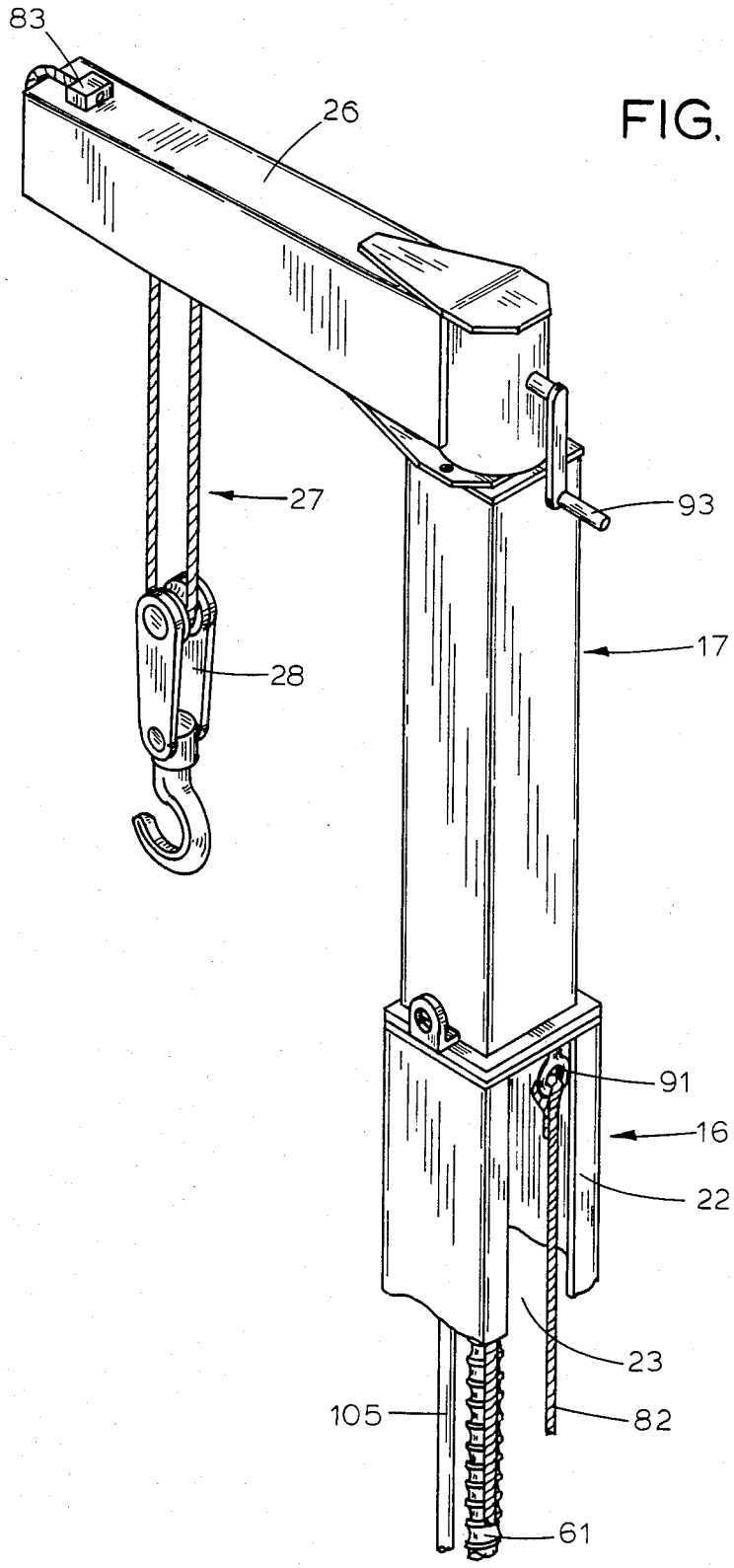
FIG. 2 is an enlarged perspective view of the jib mast which forms an upright extension on the main mast.

Referring to FIG. 1 of the drawings, the climbing form hoist of this invention is illustrated as including an upright mounting or support frame 20, a main mast 16 of a tubular construction, guidably received within the support frame 20 for relative up and down movement, and a jib mast 17 (FIG. 2) which constitutes an upright extension on the main mast 16. The support frame 20 (FIG. 1) adjustably carries an outer or mast form unit 18 for adjustment laterally thereof and relative to the outer surface of a concrete wall 19 being constructed. The main mast 16 has a lower section 21 and an upper section 22 which is formed with transversely opposite longitudinally extended slots 23 and 24 (FIGS. 1 and 2) for a purpose to appear later. A jib 26 on the jib mast 17 extends laterally in a direction to extend over the wall 19 and is provided with a cable lift means 27 that includes a lift hook 28 engageable with an inner or jib form unit 29 (FIGS. 11–15)

The support frame 20 (FIG. 7) includes generally an upright guideway 31 for guidably receiving the upper section 22 of the main mast 16. The guideway 31 is of a generally U-shape in transverse section having side or leg panels 32 and a base panel 33 opposite the wall 19. The side panels 32 are connected adjacent the upper and lower ends thereof by brace members 34 only one of which is shown in FIGS. 1 and 7. The inner surface of the side panels 32, base panel 33 and brace members 34 are suitably equiped with friction pads 36 for contact engagement with associated outer surface portions of the upper mast section 22.

The mast form unit 18 (FIG. 1) is mounted in the guideway 31 for up and down movement therewith relative to the upper mast section 22 by means including an upper mounting structure 37 and lower stabilizing arms 38. The upper mounting structure 37 includes a pair of tubular arm members 39 of a rectangular shape in transverse cross section arranged adjacent the outer sides of the legs 32 of the guideway 31 (FIGS. 1 and 7). The ends of the arms 39 adjacent the mast form unit 18 are connected together by a brace member 41 secured by a horizontal pivot 42 to the mast form unit 18. The opposite ends of the arms 39 at the open side of the guideway 31 are secured together by a brace member 45.

Each arm member 39 is slidably received within a bearing unit, indicated generally at 40, each of which is secured to an adjacent guide panel 32. Extended longitudinally above each arm 39 is a screw and nut assembly 43 having one end 55 pivotally secured to a bearing unit 40 and a screw 44 projected from the opposite end thereof for rotatable support in a bearing 46 mounted on the brace member 45. The screws 44 are concurrently rotated by a crank arm 47 through a chain and sprocket drive 48. It is seen, therefore, that on manipulation of the handcrank 47 the upper mounting structure 37 is moved laterally of the guideway 31 to in turn provide for the adjustment of the mast form unit 18 relative to the wall 19 being constructed.

The stabilizing arms 38 have their ends remote from the mast form unit 18 connected together by a brace member 49 (FIG. 1) which in turn is connected to the arms 39 of the mounting structure 37 by a pair of upright plate members 50 arranged in a side by side relation with and to the outside of an adjacent leg panel 32 of the guideway 31. A screw and nut assembly 51 extends longitudinally of each stabilizing arm 38 with one end 52 secured to the guideway 31 and operated by a hand crank 53 in the same manner as the screw and nut assemblies 43 for the upper mounting structure 37. With one of the ends 54 of the stabilizing arms 38 secured to the mast form unit 18, and the opposite ends thereof secured to the brace member 49 by horizontal pivots 56, it is seen that by manipulation of the hand cranks 47 and 53 the mast form unit 18 is adjustable for movement toward and away from the plane of the outer surface of the wall 19 concurrently with being relatively tiltable about the pivots 42 and 56 for alignment into such plane. Manual adjustment of the cranks 47 and 53 is permitted by the provision of an operator's platform 57 supported on beams 58 secured to the lower end of the guideway 31.

Relative up and down movement between the main mast 16 and support frame 20 is accomplished by the provision of a screw shaft and nut drive assembly 59 (FIGS. 4 and 5) which includes a screw shaft 61 rotatably positioned within bearings 60 (FIGS. 3 and 5) in the mast section 22 and extended longitudinally over the full length of the upper mast section 22. The shaft 61 is reversibly operated by a reversible electric motor 62 (FIG. 5) connected in a direct driving relation with the lower end of the screw shaft 61 through a suitable gear reduction unit 63 and flexible coupling 65 (FIG. 5).

Figure 6:
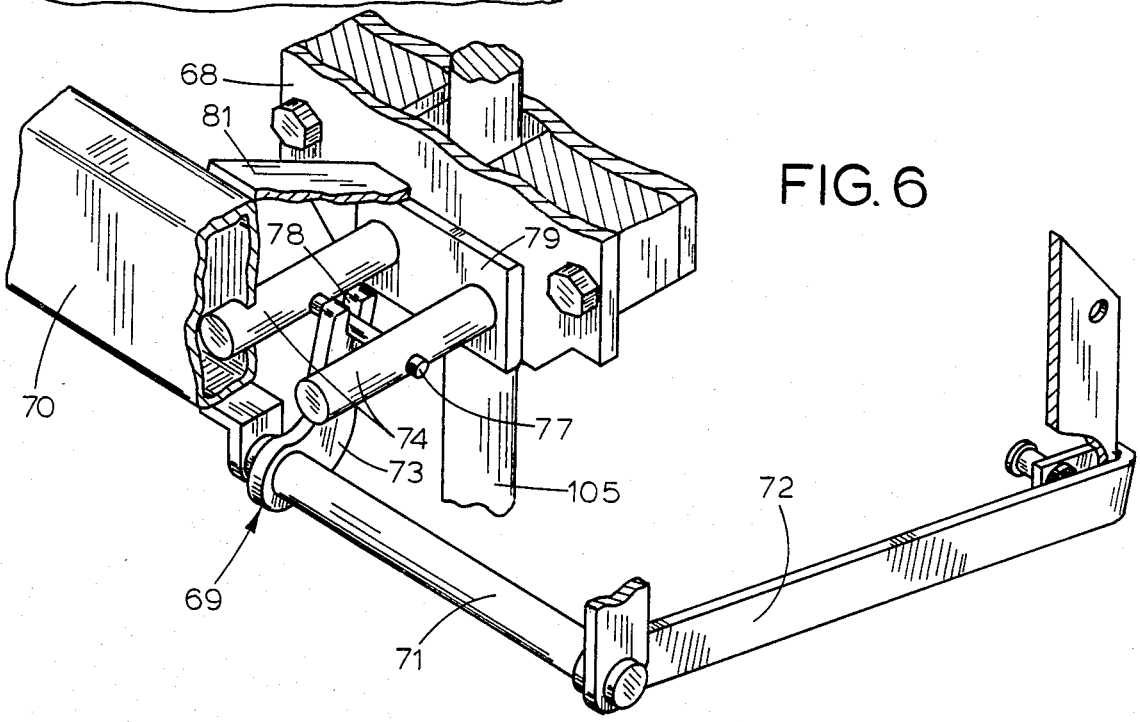
FIG. 6 is an enlarged detail perspective view with parts broken away and other parts shown in section showing the structure for releasably locking a support frame and an elevator or carriage unit against relative movement.

The nut member 64 for the screw and nut drive assembly 59 is mounted in a carriage or elevator unit 66 (FIG. 4) that has a housing 67 guidably movable within the upper section 22 of the mast 16. When the support frame 20 is to be moved relative to the mast 16 the elevator unit 66 is releasably locked to the side wall 68 of the housing 67 by a locking structure, indicated generally at 69, (FIGS. 4 and 6) which includes a tubular mounting member 70 secured to the base panel 33 of the guideway 31. A rock shaft 71 (FIGS. 4 and 6) rotatably supported from the mounting member 70 is provided at one end thereof with a rock arm 72 arranged for up and down rocking movement by an operator on the platform 57. Mounted on the rock shaft 71 for oscillating movement therewith is an actuating lever 73 for a pair of locking pins 74 movable into and out of engagement with the wall or locking plate 68 of the housing 67.

Figure 4:
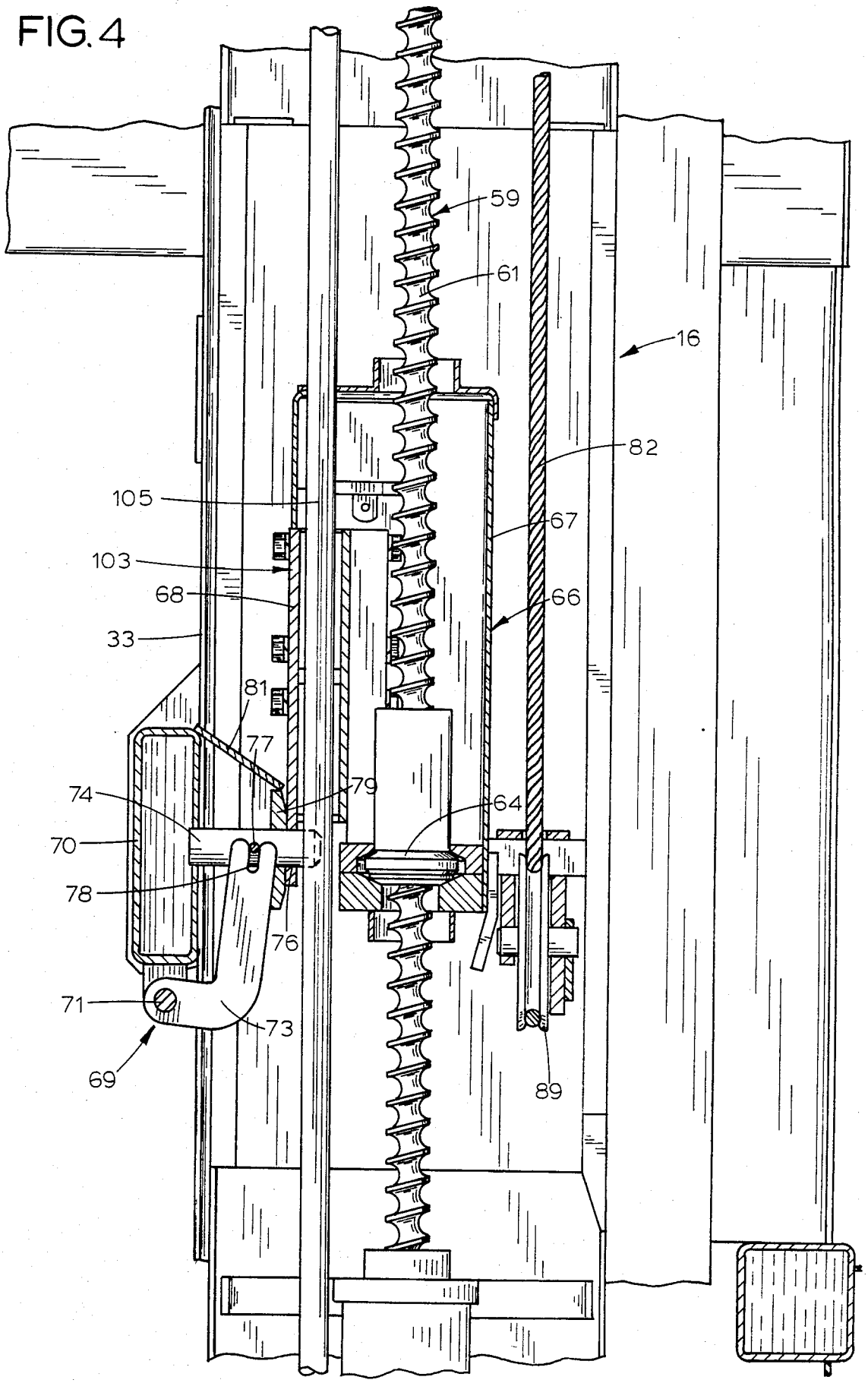
FIG. 4 is an enlarged detail longitudinal sectional view of the upper section of the main mast showing a ball and screw drive system which is selectively operable to actuate the jib lift means or to relatively move the support frame and the main mast.
Figure 5:
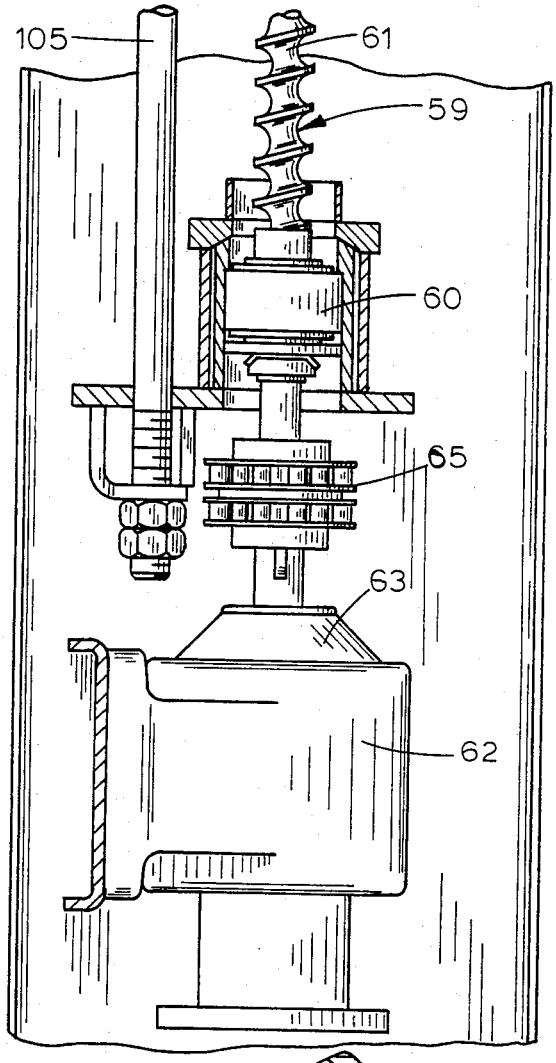
FIG. 5 is an enlarged detail sectional view of the drive end of the nut and screw power transmission or drive system.

As best appears in FIG. 4, the pins 74 in response to a rocking movement of the actuating lever 73 are moved into and out of openings 76 in the locking plate 68 through a connecting pin 77 extended between and connected to the locking pins 74 and receivable within a notch 78 formed in the free end of the actuating lever 73. The locking pins 74 are guidably supported within the mounting member 70 and a guide plate 79 for guiding insertion within the openings or holes 76. Any suitable means (not shown) provided on the support frame 20 may be used in association with the free end of the rock arm 72 to indicate an aligned position of the locking pins 74 with their associated openings 76 in the locking plate 68.

It is seen, therefore, that with the locking structure 69 in the locking position thereof shown in FIG. 4 that rotation of the screw 59 will operate to move the support frame 20 and carriage structure 66 as a unit relative to the upper mast section 22. On release of the locking pins 74 from the locking plate 68 the carriage structure 66, on rotation of the screw 61, will move independently of the support frame 20 relative to the upper mast section 22.

Figure 3:
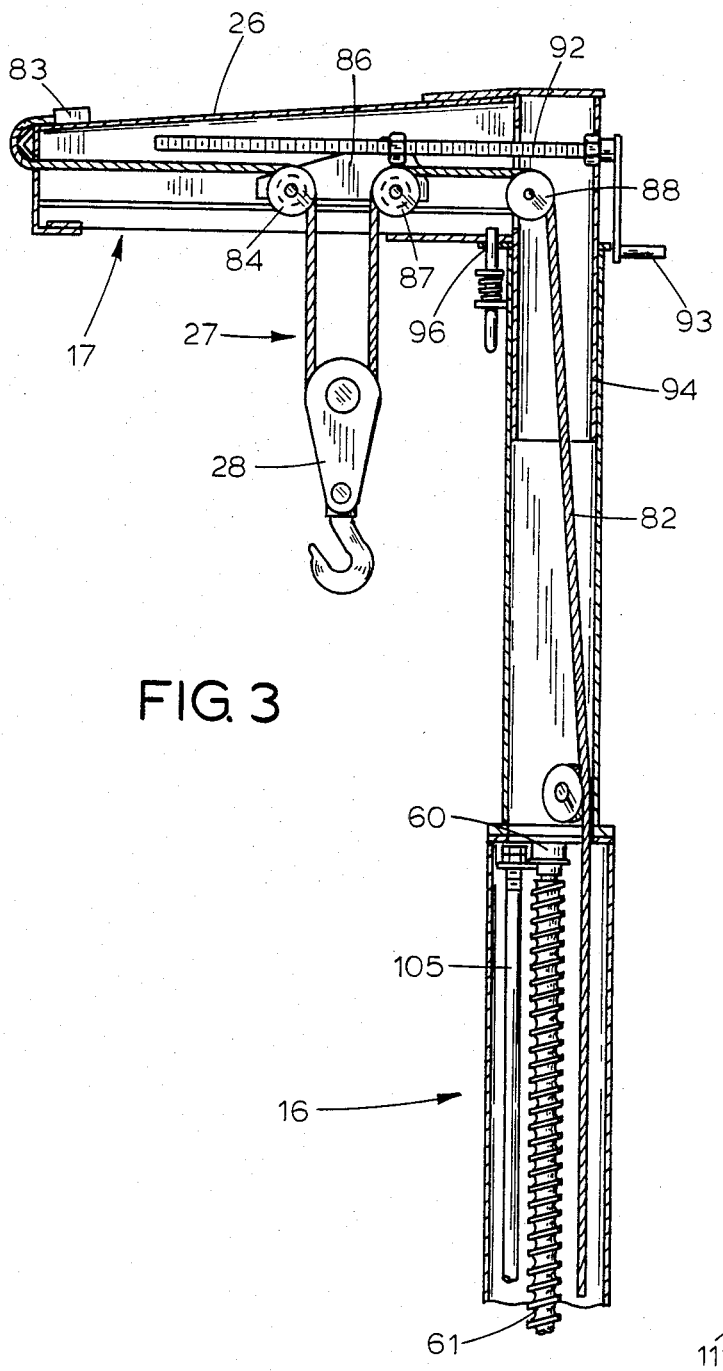
FIG. 3 is a longitudinal sectional view of the jib mast illustrated in FIG. 2 showing the lift means for handling the inner or jib form unit.

The movement of the carriage structure 66 relative to the mast 16 functions to operate the lift means 27 on the jib mast 17. Referring to FIG. 3, the lift means 27 is illustrated as including a single cable 82 which from one end 83 secured to the free end of the jib 26 is trained about a pulley 84 on a trolley 86 for travel about the block for the lift hook 28 and a second pulley 87 on the trolley 86 and then about a pulley 88 at the upper end of the jib mast 17 and downwardly through the jib mast 17 and upper section 22 of the main mast 16 to be trained about a pulley 89 on the carriage structure 66 (FIG. 4). From the pulley 89, and referring to FIG. 2, the cable 82 extends upwardly for securement at 91 to the lower end of the jib mast 17 at the mast opening 23. With the carriage structure 66 released from locking engagement with the support frame 20, rotation of the screw 61 functions to raise and lower the lift hook 28 independently of any relative movement between the support frame 20 and the main mast 16.

The trolley 86 is movable longitudinally of the jib 26 (FIGS. 2 and 3) to a selected position by a nut and screw assembly 92 provided with an operating crank 93. Additionally, it will be seen that the jib 26 is rotatably supported at 94 within the upper end of the jib mast 17 for rotational movement through an angular distance of about 180°, with a rotated position being maintained by a usual pin and hole connection 96. Any suitable ladder means may be provided on the mast 16 for operator access to the platform 57 and crank 83.

In the operation of the climbing form hoist, the wall 19 being constructed is initially built to a height of about three stories and formed at previously determined vertically spaced positions with holes 97 (FIG. 11) transversely therethrough to receive anchoring bolts 95 to which are secured wall mounting members 98 carried on the mast lower section 21. This initial support of the form hoist on the wall 19 requires the use of a crane. In addition to the mounting locations 97, each pour or wall panel section 99 is formed with a mounting location 101 to receive an anchor bolt 100 for securing a pedestal or sill beam 102 to the wall on which the outer or mast form unit 18 is supported in a new pour position, it being understood that the vertical height of the mast form unit 18 corresponds to a story height of the wall being constructed. For a nine foot floor to floor height, the hoist would have an overall height of about twenty-eight feet; and for a maximum floor to floor height of thirteen feet, the hoist would have an overall height of forty feet.

Figure 11:
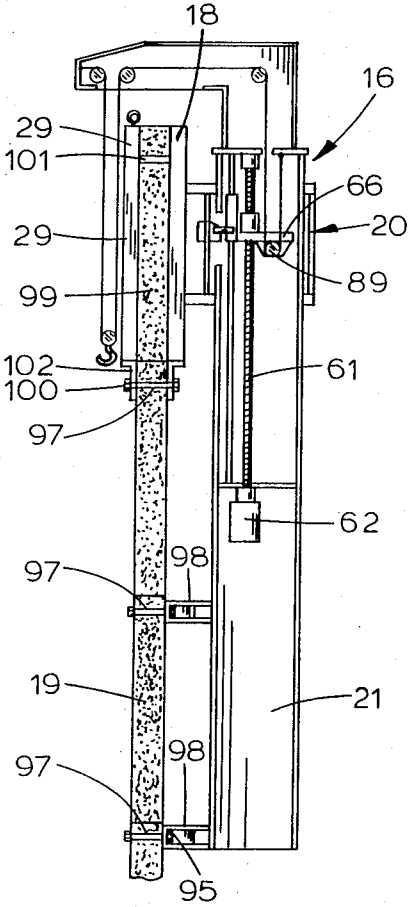

Let it be assumed, and as illustrated diagrammatically in FIG. 11, that a pour has been made and set and the climbing form hoist is to be moved to the next floor level. With the mast form unit 18 and jib form unit 29 still in place on the wall 19, the mountings 98 are released from the anchor locations 97 and the screw 61 is rotated in a direction to lift the main mast 16 relative to the support frame 20 for securement to the wall 19 at a next pair of anchor locations 97 to the position illustrated in FIG. 12, it being understood that the carriage structure 66 and support frame 20 are locked together during this mast raising operation.

Figure 14:
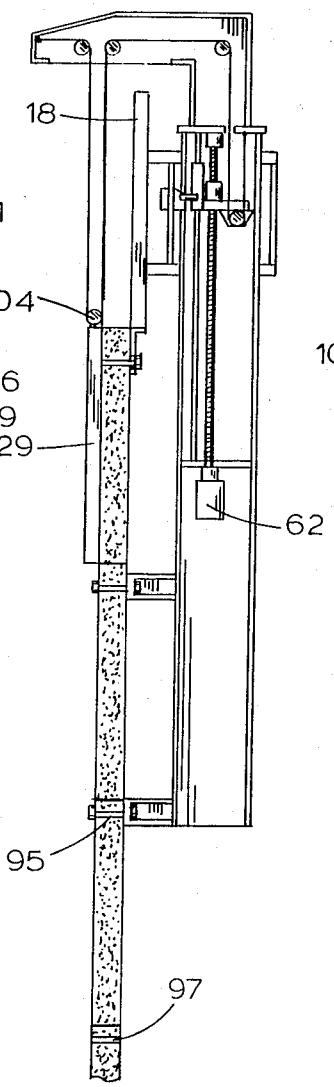
Figure 13:
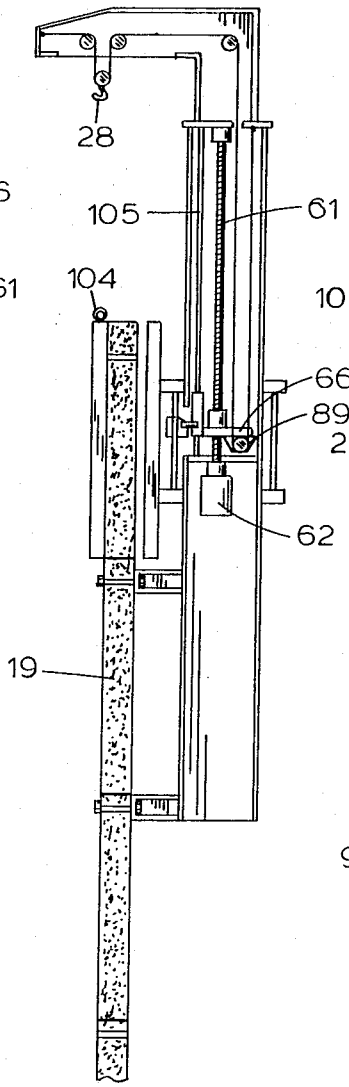
Figure 12:
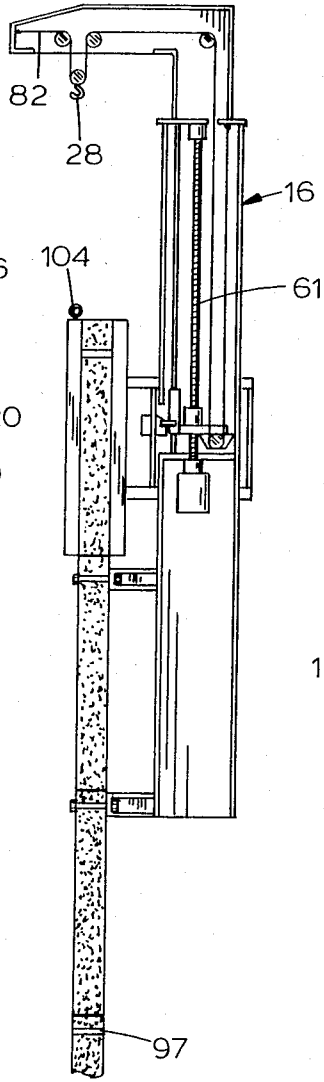

With the hoist resecured to the wall 19, the support structure 37 for the mast form unit 18 is manipulated through the cranks 47 and 53 to break the mast form unit 18 loose from the wall 19 to its position shown in FIG. 13. At this time the lift hook 28 is in an uppermost moved position as a result of the pulley 89 on the elevator or carriage structure 66 being at the lower end of the mast upper section 22. On rotation of the screw 61, therefore, the mast form 18, support frame 20, and elevator structure 66 are moved upwardly as a unit relative to the upper mast section 22 to a position wherein the mast form unit 18 is supported on the previously secured beam 102 and then adjustably moved in response to manipulation of the hand cranks 47 and 53 to a next pouring position. Concurrently with raising of the mast and form unit 18 to the new pouring position, the lift hook 28 is lowered for engagement with an eye bolt 104 on the jib form 29 (FIG. 14). The elevator structure 66 is then released from the support frame 20 and the screw 61 is rotated in a direction to lower the elevator structure 66 in the upper mast section 22 whereby the cable 82 is actuated to elevate the jib form 29 to the new pouring position. The elevator structure 66 is thus moved from its elevated position in FIG. 14 to its lowered position in FIG. 15 independently of the frame support 20.

On completion of the new pour, the carriage structure 66 is elevated by operation of the screw 61 into its position of FIG. 11 for locking engagement with the support frame 20. During this upward travel of the carriage or elevator structure 66, it is seen that the cable 82 is extended downwardly from the jib 26 so that the cable hook 28 is dropped inwardly of the jib panel 29. The cycle of a pour is thus completed and the procedural steps illustrated in FIGS. 11–15, inclusive, are repeated for successive pours.

Figure 9:
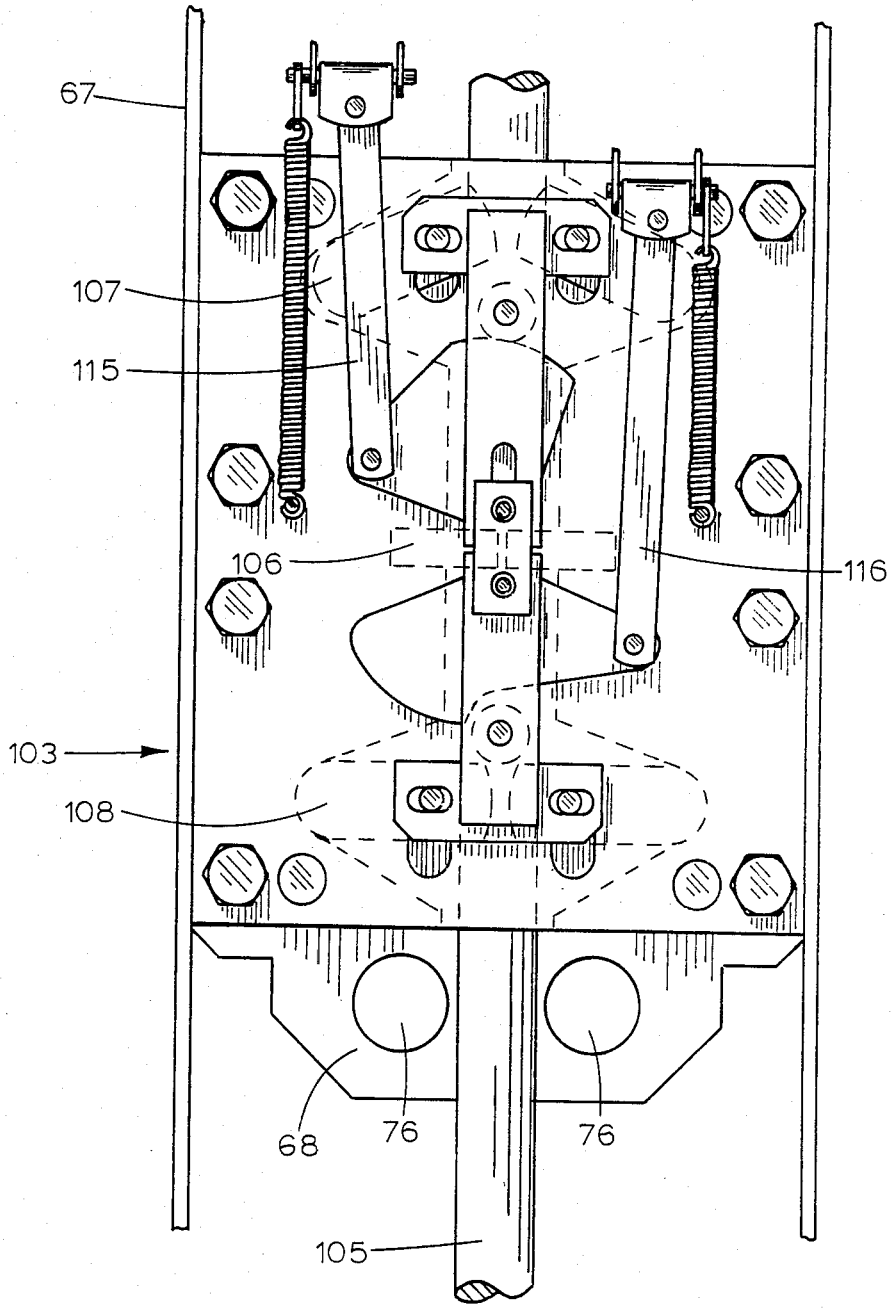
FIG. 9 is an enlarged front elevational view of the emergency brake mechanism.
Figure 15:
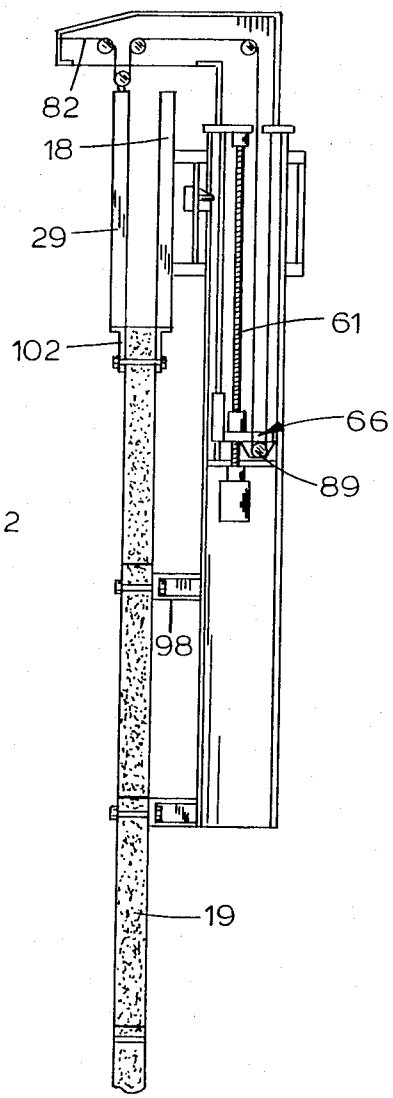
FIGS. 11–15, inclusive, diagrammatically illustrate the sequential operating steps providing for the climbing of the hoist from a set pour to a new pouring position and for the handling of the mast and jib form units during such sequence.

In the event of any failure of the screw and nut power transmission or drive system 59 by reason of wear, breakage or failure of electrical power to the motor 62, the support frame 20, mast 16, and carriage structure 66 will automatically be held in their relative positions as of the time of such failure. This automatic holding together of such hoist structure is automatically provided by a brake mechanism 103 (FIGS. 4, 8 and 9) and includes a holding or brake rod 105 extended longitudinally of and within the mast upper section 22 in a parallel relation with the screw 61. The mechanism 103 is secured to the locking plate 68 at a position within the carriage or elevator housing 67 with the rod 105 extendible through a centering guide or ring 106. A pair of locking arms 107 and 108 are spaced axially of the rod 105 to opposite sides of the centering guide 106. Each pair of arms 107 and 108 is adapted for gripping engagement with transversely opposite side portions of the rod 105. In operation, one pair of the locking arms 107 or 108 is positioned to freely move along the rod 105, while the other pair of the locking arms 107 or 108 rides freely on the rod 105 in only the direction of movement of the elevator structure 66. In the event of a riding movement of the one pair of locking arms in an opposite direction, as a result of power failure or the like, such locking arms will be progressively moved into a gripping engagement with the rod 105 to lock the carriage structure 66 against movement relative to the rod 105.

The complementary action of the locking arms 107 and 108 is reversed for a reverse movement of the carriage structure 66 along the rod 105. Stated otherwise, the pairs of arms 107 and 108 operate alternately depending upon the directional movement of the elevator structure 66. The brake setting positions of the locking arms 107 and 108 may be accomplished by any suitable means such as electrical solenoids 113 (FIG. 10) operatively associated with the link and cam mechanisms 115 and 116 for the arms 107 and 108, respectively. It is to be understood that following the braking action by either pair of arms 107 and 108 with the rod 105 that the peripheral surface of the rod 105 at the braking zone thereof will become deformed as a result of the cold rolling action of the locking arms relative to the rod. This gripping or cold roll action of the locking arms eliminates any sudden or drop fall of any of the hoist structure with resultant impact damage. The deformation of the rod 105 by the cold roll braking action will require replacement of the rod following each automatic braking operation.

Figure 10:
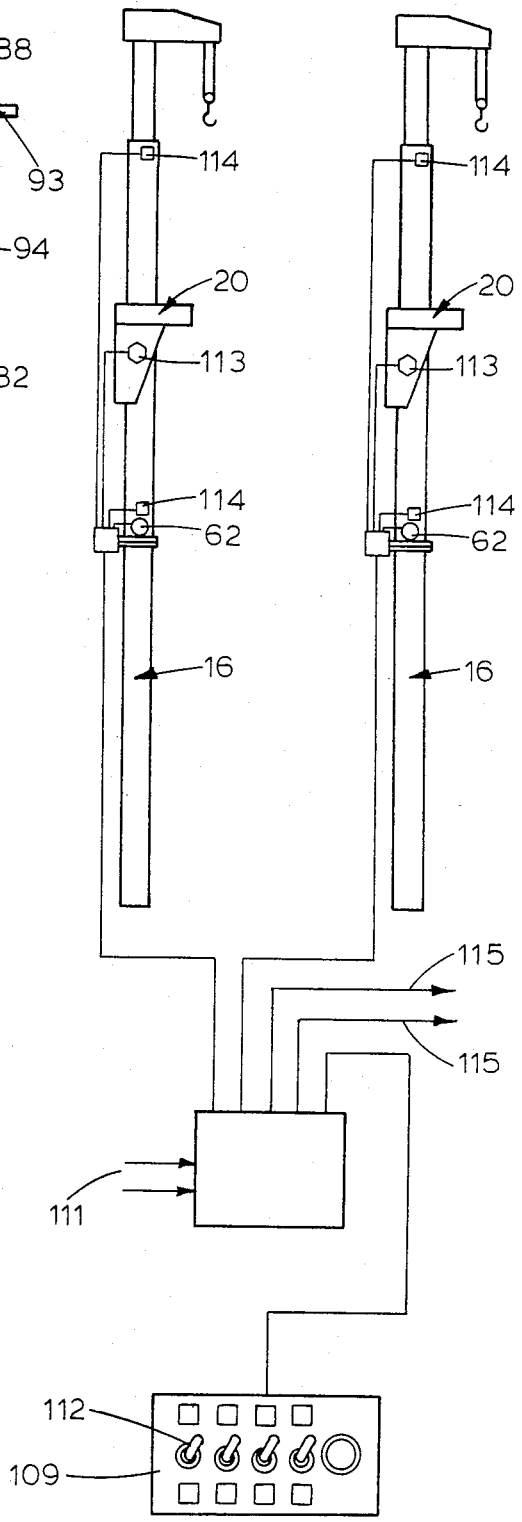
FIG. 10 is a diagrammatic illustration of an electrical control circuit for separately or jointly operating a plurality of climbing form hoists.

Although the invention has been described with respect to a single climbing hoist form, it is to be understood and as illustrated in FIG. 10, that a plurality of such hoists may be used in the handling of gang forms and wherein each hoist is capable of being operated jointly or individually relative to other hoists from a remotely controlled station indicated at 109. By virtue of the screw and nut drive system 59 of each hoist being in a driven relation with a single reversible electrical motor 62, the gang forms can be adjusted to relatively moved positions providing for their removal from the wall and positioning on the wall to new pouring locations. Power for the remote control system is available from a suitable source of a.c. power indicated at 111 and the electrical circuit would include electrical switches 112 for controlling the operation of the motors 62 and connections for the solenoids 113 associated with the locking arms 107 and 108. Safety switches indicated at 114 may also be located at opposite ends of the screw shaft 61 for controlling load conditions on the screw.

Two hoists are illustrated in FIG. 10 with electrical connections 115 being indicated for an additional pair of hoists corresponding to the number of switches 112 on the remote control panel 109. Scaffolding (not shown) would be carried on and extended between the hoists for convenient accessibility to the platforms 57 and cranks 47, 53 and 93 and rock arm 72.

Although the invention has been described with respect to a preferred embodiment thereof, it is to be understood that it is not to be so limited since changes and modifications can be made therein which are within the full intended scope of this invention as defined by the appended claims.

I claim:

1. A wall climbing form hoist for handling inner and outer form units in the successive pouring of horizontal panels of a concrete wall structure comprising:

(a) a frame means having an outer form unit mounted thereon, (b) a tubular mast movably supported on said frame means for relative up and down movement, said mast having an upper section and a lower section, (c) reversible power transmission means within the upper section of the mast including a rotatable drive means and a linearly movable driven unit, (d) means releasably connecting the driven unit to said frame means, (e) said power transmission means, when the driven unit is releasably connected to the frame means and the outer form unit and inner form unit are mounted on and connected to the wall structure, being rotated in one direction to move the mast section upwardly relative to said frame means, and, when the lower mast section is secured to the wall structure and the driven unit is released from the frame means, being rotated in reversed directions to linearly move the driven unit up and down within the upper mast section, (f) a jib on the upper mast section having a lift means for the inner form unit, and (g) means for operating said lift means in response to the up and down movement of the driven unit relative to said frame means.

2. The wall climbing form hoist of claim 1, including:

(a) means adjustably mounting the outer form unit on the frame means for movement to an adjusted position relative to the plane of the outer surface of the concrete wall structure.

3. The wall climbing form hoist of claim 1, wherein:

(a) said drive means comprises a screw shaft extended longitudinally of and within the upper section of the mast, and (b) said driven unit comprises a carriage structure movable longitudinally of said upper mast section and including a nut member in operative association with said screw shaft for movement of the carriage structure axially of the screw shaft in response to rotation of the screw shaft, (c) a reversible electric motor for rotating said screw mounted within said mast adjacent the lower end of said screw shaft, and (d) remote means for controlling the operation of said motor.

4. The wall climbing form hoist of claim 1, wherein:

(a) said lift means includes a trolley on said jib including a cable suspended lift hook, and (b) a cable trained about pulleys on said trolley, on said upper mast section and on said driven unit whereby said lift hook is actuated in response to the up and down movement of the driven unit.

5. The wall climbing form hoist according to claim 3, including:

(a) a brake means for automatically locking the carriage structure against a free movement relative to the upper mast section including a brake rod supported in said upper mast section in a parallel relation with said screw shaft and coacting gripping fingers on said carriage structure.

6. The wall climbing form hoist according to claim 4, including:

(a) means movably supporting said trolley on said jib for movement longitudinally thereof, and (b) means rotatably supporting the jib on the upper mast section to an adjusted position.

7. A wall climbing form hoist for handling inner and outer form units in the successive pouring of horizontal panels of a concrete wall structure comprising:

(a) an upright frame means, (b) means for supporting the outer form unit on said frame means for lateral movement relative to the outer surface of the wall structure, (c) an upright tubular mast member having a lower section connectible to the wall structure and an upper section, (d) means movably supporting said mast member on said frame means for relative vertical movement, (e) a motor operated upright screw shaft extended longitudinally of and rotatably supported within said mast upper section, (f) a nut member operatively associated with said screw shaft, (g) a carriage structure within and movable longitudinally of said mast upper section, (h) means mounting said nut member on said carriage structure, (i) means releasably connecting the carriage structure to said frame means for upward movement of the mast member relative to said frame means on rotation of said screw shaft in one direction, (j) means for releasing said connecting means for movement of the carriage structure relative to the frame means on rotation of the screw, and (k) a jib on said upper mast section including a lift means for the inner form unit actuated by means in response to the movement of the carriage structure relative to the frame means, (l) said lower mast section secured to said lower wall portion in the setting of the form units to a pour position and said frame means secured to the set form units when the mast member is moved upwardly relative to said frame means.

* * * * *